US008262901B2

(12) United States Patent
Serban et al.

(10) Patent No.: US 8,262,901 B2
(45) Date of Patent: Sep. 11, 2012

(54) ADSORBING POLYNUCLEAR AROMATICS FROM A REFORMING PROCESS USING ADSORBENTS CONTAINING IRON

(75) Inventors: Manuela Serban, Glenview, IL (US); Mark P. Lapinski, Aurora, IL (US); Mark D. Moser, Elk Grove Village, IL (US)

(73) Assignee: UOP LLC, Des Plaines, IL (US)

( * ) Notice: Subject to any disclaimer, the term of this patent is extended or adjusted under 35 U.S.C. 154(b) by 368 days.

(21) Appl. No.: 12/701,187

(22) Filed: Feb. 5, 2010

(65) Prior Publication Data

US 2011/0152589 A1 Jun. 23, 2011

Related U.S. Application Data

(60) Provisional application No. 61/287,962, filed on Dec. 18, 2009.

(51) Int. Cl.
*C10G 67/06* (2006.01)
*C07C 7/12* (2006.01)

(52) U.S. Cl. ..... 208/99; 208/310 R; 585/820

(58) Field of Classification Search ..... 208/99, 208/310 R; 585/820
See application file for complete search history.

(56) References Cited

U.S. PATENT DOCUMENTS

| | | | | |
|---|---|---|---|---|
| 3,151,056 | A | 9/1964 | Wolff et al. | |
| 4,608,153 | A | 8/1986 | Hudson et al. | |
| 4,804,457 | A * | 2/1989 | Ngan | 208/64 |
| 5,139,646 | A | 8/1992 | Gruia | |
| 5,364,514 | A | 11/1994 | Sanborn et al. | |
| 5,464,526 | A | 11/1995 | Saunders | |
| 5,583,277 | A | 12/1996 | Kuehl | |
| 5,792,898 | A | 8/1998 | Glover | |
| 6,361,683 | B1 | 3/2002 | Kalnes | |
| 6,379,532 | B1 | 4/2002 | Hoehn et al. | |
| 6,379,535 | B1 | 4/2002 | Hoehn et al. | |
| 6,824,673 | B1 | 11/2004 | Ellis et al. | |

FOREIGN PATENT DOCUMENTS

GB 1400545 8/1973

OTHER PUBLICATIONS

U.S. Appl. No. 12/701,264, filed Feb. 5, 2010, Serban et al.
Wang et al., Study on removal of aromatics from 120# solvent naphtha by adsorption, Petrol Proc. and Petrochemicals V27 N6 32-36 (Jun. 1996) Chinese with English Abstract.
Frazer et al., Improving commercial hydrocracking performance, Petroleum Technology Quarterly 4 (3) 1999 p. 25-2629-3033-35.
Resasco et al., Combined deep hydrogenation and ring opening of poly-aromatic hydrocarbons, ACS Natl. Mtg Book of Abstracts 229(2) 2005, San Diego, CA, Ameri Chemical Society.
Radwan et al., Liquid-liquid equilibria for extraction of aromatics from naphtha reformate, Fluid Phase Equilibria V129 N. 1-2 175-86 (Mar. 15, 1997) Elsevier.
Ali et al., Extraction of aromatics from naphtha reformate using propylene carbonate, Fluid Phase Equilibria 214 (1) 2004 p. 25-38.
Su, Y, Catalytic hydrogentation of reformate raffinate to make high quality solvent naphtha, Petroleum Processing SINOPEC, Research Institute, Chinese with English Abstract, (1997).

* cited by examiner

*Primary Examiner* — Randy Boyer
(74) *Attorney, Agent, or Firm* — Maryann Maas

(57) ABSTRACT

An exemplary embodiment can be a process for removing one or more polynuclear aromatics from at least one reformate stream from a reforming zone. The PNAs may be removed using an adsorption zone. The adsorption zone can include first and second vessels each vessel containing an activated carbon adsorbent. Generally, the process includes passing the at least a portion of an effluent of the reforming zone through the first vessel containing a first activated carbon adsorbent wherein the first activated carbon adsorbent comprises iron.

20 Claims, 2 Drawing Sheets

ADSORBING POLYNUCLEAR AROMATICS FROM A REFORMING PROCESS USING ADSORBENTS CONTAINING IRON

CROSS REFERENCE TO RELATED APPLICATION

This application claims priority from Provisional Application Ser. No. 61/287,962 filed Dec. 18, 2009, the contents of which are hereby incorporated by reference in its entirety.

FIELD OF THE INVENTION

This invention generally relates to a process, for adsorbing polynuclear aromatics from one or more reforming process streams using at least one adsorption zone.

BACKGROUND OF THE INVENTION

Reforming is practiced widely throughout the world and is one of the most employed hydrocarbon processing reactions. In reforming, naphthene rings derived from paraffins are dehydrogenated into aromatic rings in the presence of a catalyst. The reformate will usually contain from 35 to 60 percent by weight of benzene, toluene and xylenes. Reforming catalysts are usually noble metals, such as platinum, or mixtures of platinum metals such as platinum and rhenium, on acidic supports such as alumina. Potential problems common to reforming processes include polynuclear aromatic (hereinafter may be abbreviated "PNAs") content in the reformate and heat balance in the overall endothermic catalytic process.

If PNAs are not already present in the feed, they may be formed in the reforming processes. PNAs can form coke on the catalyst and foul units. Typically, PNAs include compounds having a plurality of fused aromatic rings and include compounds such as coronene and ovalene. As a result, it is desirable to remove PNAs from the one or more streams containing reformate to minimize catalyst deactivation through coking Adsorbent beds may be utilized to remove polynuclear aromatics from such reformate streams. After the adsorption capacity of the adsorbent is exhausted, the adsorbent may be disposed or regenerated.

U.S. Pat. No. 4,804,457 teaches the use of inter reactor PNA adsorption traps situated in a reforming process intermediate endothermic reforming reactors to remove any PNAs formed in the reforming process. The adsorption zone has an inorganic oxide selective for the separation of PNAs from mononuclear aromatics and normal paraffinic saturated hydrocarbons. The reference teaches that the separation to remove the PNAs from other hydrocarbons by adsorption is performed at a low temperature including from about 50° F. to 600° F.

U.S. Pat. No. 5,583,277 teaches that M41S, a molecular sieve, may be used to remove trace amounts of PNAs from reformate. U.S. Pat. No. 4,608,153 teaches the removal of PNAs using an iron-catalyst at high temperatures to selectively hydrogenate and hydrocrack the PNAs. GB1400545A teaches the removal of PNAs from gasoline or catalytic reformate using a graphite and alumina binder.

However, none of the references have provided a highly economical and efficient process for removing PNAs from one or more reformate streams. The process described herein calls for using carbon adsorbents in an adsorption zone located between at least two reforming reactors in a series of reactors, or in an adsorption zone located at the effluent of the last of a series of reforming reactors. The adsorption zone contains carbon adsorbent comprising iron. In one embodiment the activated carbon adsorbent comprises from about 1000 to about 50,000 ppm iron on a carbonaceous basis.

SUMMARY OF THE INVENTION

One embodiment of the invention is a process for adsorbing one or more polynuclear aromatics from at least one stream comprising reformate from a reforming zone using at least one adsorption zone, by passing at least a portion of at least one stream comprising reformate from the reforming zone through the adsorption zone wherein the adsorption zone comprises an activated carbon comprising iron and recovering reformate from the reforming zone having a reduced concentration of polynuclear aromatics. The reforming zone may be a series of reforming reactors and the stream comprising reformate may be at least a portion of the effluent of any of the reforming reactors in the series of reforming reactors. The PNAs may have three or greater fused rings, such as anthracenes, benz-antracenes, pyrenes, benzo-pyrenes, coronenes and ovalenes. Two adsorption zones containing activated carbon adsorbents comprising iron may be operated in a lead-lag mode of operation. The activated carbon adsorbent may comprise from about 1000 to about 50,000 ppm iron on a carbonaceous basis The activated carbon adsorbent may be coconut shell, coal, lignite activated carbons, wood activated carbons or mixtures thereof. An example is bituminous coal.

One or more of the PNAs are desorbed from the second activated carbon adsorbent comprising iron in the second adsorption zone by passing a petroleum fraction boiling in the range of about 200° C. to about 400° C. through the second adsorption zone. The temperature for desorbing at least one PNA from the second activated carbon adsorbent includes about 10° C. to about 500° C. and a pressure from about 170 kPa to about 21,000 kPa.

In another embodiment, the invention is a process for generating a hydrocarbon reformate with a reduced amount of polynuclear aromatic compounds. The process involves passing a heated hydrocarbon feed stream through a series of endothermic catalytic reforming reactors operated at a temperature of from about 427° C. to about 538° C. to reform the feed stream in the presence of a reforming catalyst to a hydrocarbon of higher octane value and to provide for at least one reforming reactor effluent containing polynuclear aromatic compounds. Next, the reforming reactor effluent is contacted with a first activated carbon adsorbent comprising iron effective to selectively adsorb the polynuclear aromatic compounds and to permit non-polynuclear aromatic hydrocarbons to pass over the first activated carbon adsorbent without being adsorbed and to form a first adsorbent bed effluent stream having a reduced amount of polynuclear aromatic compounds. The first adsorbent bed effluent stream may be passed to a final or second series of endothermic catalytic reforming reactors operated at a temperature of from about 427° C. to about 528° C. to reform the first adsorbent bed effluent stream to a hydrocarbon of higher octane value and to provide for a second reforming reactor effluent containing polynuclear aromatic compounds. A hydrocarbon reformate having a reduced content of polynuclear aromatic compounds may be recovered from the final or last of the series of reforming reactors. The feed stream may contain C6 to C12 naphtha having a boiling point in the range of about 38° C. to about 204° C. and the reformate has a higher octane than the feed. The invention may employ a second adsorption zone containing a second activated carbon adsorbent comprising iron where the first and second adsorption zones operate in a lead-lag mode of operation. One or more of the PNAs are desorbed from the second activated carbon adsorbent in the second adsorption zone by passing a petroleum fraction boiling in the range of about 200° C. to about 400° C. through the second adsorption zone. The petroleum fraction may be substantially in the liquid phase. The temperature for desorbing at least one PNA from the second activated carbon adsorbent may include a temperature from about 10° C. to about 500° C. and a pressure from about 170 kPa to about 21,000 kPa.

Yet another exemplary embodiment can be a refining or petrochemical manufacturing facility. Generally, the facility includes an adsorption zone, a hydrocracking zone, and a first fractionation zone. An adsorption zone may be adapted to receive a recycle oil having up to about 10,000 ppm, by weight, of one or more polynuclear aromatics and a light cycle oil, and the adsorption zone is adapted to send the light cycle oil downstream of a fluid catalytic cracking zone. Also, the reforming zone can be adapted to receive at least a portion of the recycle oil, in turn having no more than about 1,000 ppm, by weight, of one or more polynuclear aromatics from the adsorption zone and provide an effluent. The first fractionation zone may be adapted to receive at least a portion of the effluent and provide at least a portion of the recycle oil to the adsorption zone.

DEFINITIONS

As used herein, the term "stream" can be a stream including various hydrocarbon molecules, such as straight-chain, branched, or cyclic alkanes, alkenes, alkadienes, and alkynes, and optionally other substances, such as, gases, e.g., hydrogen, or impurities, such as heavy metals, and sulfur and nitrogen compounds. The stream can also include aromatic and non-aromatic hydrocarbons. Moreover, the hydrocarbon molecules may be abbreviated C1, C2, C3 . . . Cn where "n" represents the number of carbon atoms in the hydrocarbon molecule. Typically, one or more streams, in whole or in part, may be contained by a line or a pipe.

As used herein, the term "zone" can refer to an area including one or more equipment items and/or one or more sub-zones. Equipment items can include one or more reactors or reactor vessels, heaters, exchangers, pipes, pumps, compressors, and controllers. Additionally, an equipment item, such as a reactor, dryer or vessel, can further include one or more zones or sub-zones.

As used herein, the term "adsorption" can refer to the retention of a material in a bed containing an adsorbent by any chemical or physical interaction between the material in the bed, and includes, but is not limited to, adsorption, and/or absorption. The removal of the material from an adsorbent may be referred to herein as "desorption."

As used herein, the term "substantially" can mean at least about 80%, about 90%, about 95%, or even about 99%, by weight.

As used herein, the term "at least one fraction" can mean a stream of, e.g., hydrocarbons that may or may not be a product of a fractionation zone.

DETAILED DESCRIPTION

Figure 1:
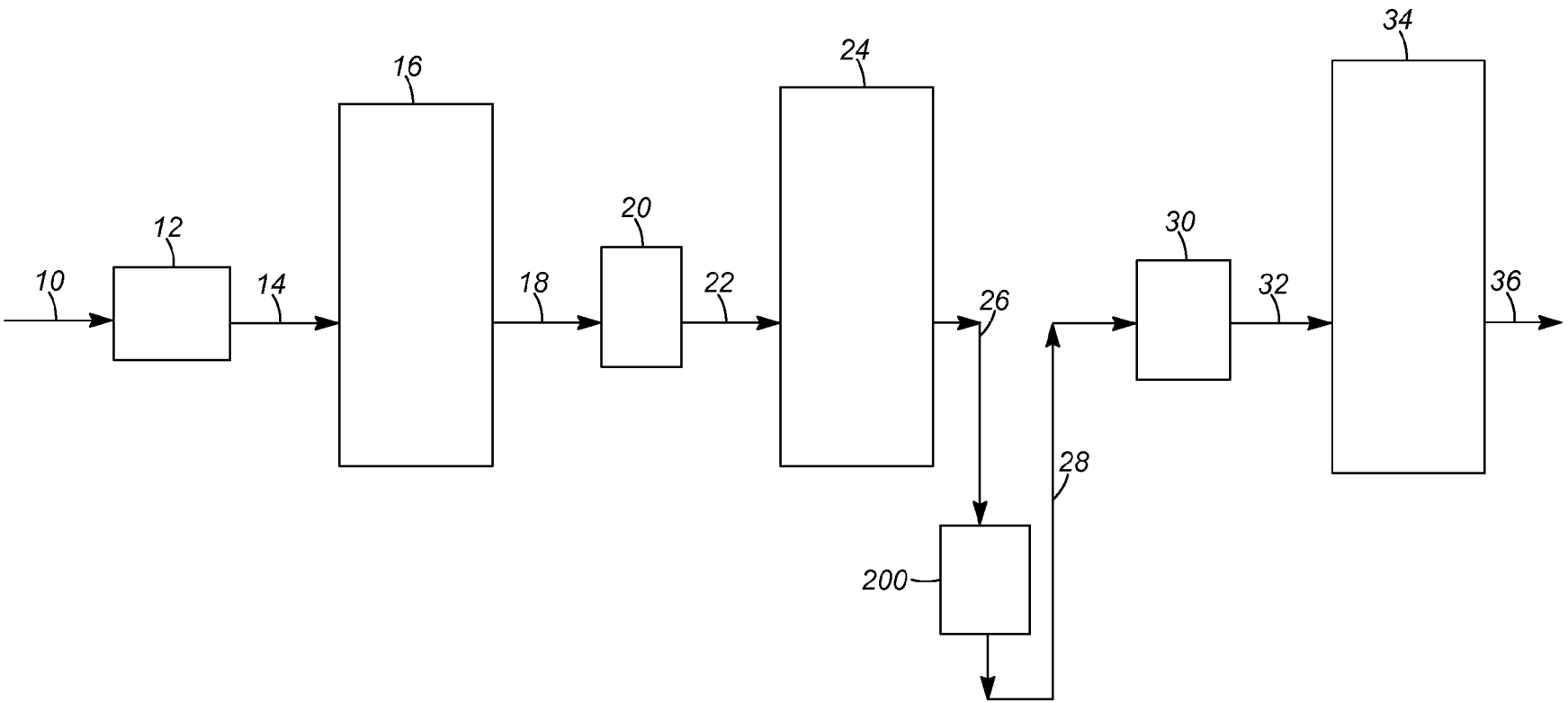
FIG. 1 is a schematic depiction of an exemplary refining or petrochemical manufacturing facility that includes an exemplary adsorption zone.

This invention is concerned with a process for the reformation of paraffins, particularly aliphatic paraffins containing six or more carbon atoms, into aromatic material via dehydrocyclization, isomerization and dehydrogenation reactions. Some olefins may be present in the feedstock. A preferred feedstock of this invention comprises C6 to C12 naphthas having a boiling point in the range of about 38° C. to about 204° C. Mixtures of paraffins and naphthas may also be utilized as feedstock where the mixture has a boiling range of from boiling point in the range of about 38° C. to about 204° C.

In such reformation processes most of the reactions are endothermic in nature although cracking and isomerization reactions can take place which reduce the observed endotherms especially in the tail reactors. Therefore, a plurality of adiabatic fixed-bed reactors are typically used in series with provision for inter-stage heating of the feed to each of the several reactors. The additional heat may be added from the use of heat exchangers or fired heaters to elevate the temperature of the hydrocarbons between reforming reactors. Most reforming operations are performed in the presence of hydrogen which acts as a diluent for the reformation of the hydrocarbons.

Catalytic materials used in the reforming reaction are conventional dehydrocyclization reforming catalysts exemplified by metals deposited on an inorganic oxide support. Specific examples of these metals will be selected from Group VIII and include ruthenium, rhodium, palladium, osmium, iridium, and platinum. Promoter or other additives can be incorporated including but not limited to tin, rhenium, germanium, gallium, lanthanides, indium, and phosphorus. Reforming process conditions generally include temperatures of from about 399° C. to about 677° C. (about 750° F. to about 1250° F.) and preferably between about 482° C. to about 566° C. (about 900° F. to about 1050° F.), and pressures generally in the range of about 345 kPag to about 2758 kPag (about 50 psig to about 400 psig). The hydrocarbon feed rate for a reforming process is expressed in weight hourly space velocity (WHSV) and is typically in the range of from about 0.5 to about 3.0. Hydrogen is present during reforming in surplus quantities of that needed for the reforming reaction.

The temperature in the lowermost portion of each adiabatic reforming bed should not be less than about 399° C. (750° F.) to insure proper catalytic reforming of the hydrocarbons. Therefore, a heating means is placed intermediate each particular adiabatic reforming bed to raise the temperature of the reforming hydrocarbon in that bed to a level of approximately 482° C. to 538° C. (900° F. to 1000° F.). This insures that the temperature in the bottom-most portion of the adiabatic reforming bed is maintained at a level of at least 399° C. (750° F.). The reheat of the reactor effluent stream can be accomplished by heat exchange with other refinery process flow streams or via fired heaters, electric heaters or any other conventional heating method. This is also known as interstage heating.

The polynuclear aromatic adsorption from the reformate effluent of any reforming bed may take place prior to or after intermediate heating as it has been discovered that contrary to prior teachings, the adsorbing of polynuclear aromatics by the selective adsorbent may be conducted at temperatures at least 370° C. (700° F.) and greater. Prior art teachings such as U.S. Pat. No. 4,804,457, require that the adsorption zone be operated at a temperature of from about 10° C. to about 315° C. (50° F. to about 600° F.). Operating the adsorption zone at the higher temperature as is possible with the present invention, means there is no need for cooling of the effluent of a rector to below 370° C. (700° F.), which significantly reduces the amount of reheat needed to achieve the reforming inlet temperature for the next reforming reactor. Utility and construction costs are conserved.

The polynuclear aromatics removed by this process contain from about two to about ten aromatic rings. While it is contemplated that naphthalenes may also be removed, it is not absolutely critical that they be removed in order to have a reformate of extremely high octane quality. The reformate produced by this process should contain a significant portion of aromatics with any paraffins comprising the majority of the other components. This intermediate system of polynuclear aromatic adsorption drastically reduces the polynuclear aromatic content of the reformate. If necessary, the paraffinic materials can be separated from the reformate and recycled to the reforming stages for conversion into high octane aromatic materials.

It is within the scope of the invention to optionally remove any polynuclear aromatics from the feed prior to contact with the first reforming reactor. Not all feed streams contain polynuclear aromatics, however. In many applications, the polynuclear aromatics are generated in the reforming reaction zones. An adsorption zone containing an adsorbent selective for the adsorption of polynuclear aromatics is located before the first reforming reactor bed, in between at least two of the reforming reactor beds, after the last reforming reactor bed, or any combination thereof. The adsorption materials which are selective for the polynuclear aromatic hydrocarbons, comprise a molecular sieve, silica gel, silica, alumina, activated alumina, activated carbon, silica-alumina and various clays, with the adsorption sieve also comprising iron. It is not necessary that the adsorption material be comprised of a specific material as long as it is selective for the adsorption of the polynuclear aromatics from the paraffins and reformate. Applicants have found that adsorption sieves which also comprise iron are successful at adsorbing PNAs.

An advantage of this invention is that the removal of the polynuclear aromatics will reduce the coking rate on the catalyst in the reactors, and thereby the frequency of reforming catalyst regeneration. The reduced polynuclear aromatics in the reformate will also provide a high octane material conduit 22 at a temperature of about 538° C. (1000° F.) and passed to the second reformer reactor 24. This zone contains a similar reforming catalyst to the first reformer reactor zone 16, preferably a platinum-rhenium catalyst dispersed on alumina. Additional reformate, comprising mononuclear aromatics, is formed in reformer reactor 24 and passed in conduit 26, at a lower temperature than the feed stream 22, to adsorption zone 200.

The adsorption zone 200 is comprised of an activated carbon adsorbent comprising iron which is selective for adsorption of polynuclear aromatic compounds to the exclusion of the reformate and unconverted hydrocarbons which are passed via line 28 to third reforming zone 34. A substantially polynuclear aromatic-free reformate and feed material in conduit 28 is withdrawn from adsorption zone 200 and passed to the intermediate heat means 30 wherein this stream is heated to a temperature sufficient to provide reforming of the stream in reformer reactor 34. The heated stream is transferred from heater 30 to reforming zone 34 via conduit 32. Heat means may be either indirect or direct heat, as dictated by refinery energy demands. Additional heating zones, reforming zones and lines can exist after reformer zone 34.

After the multiple sequential process steps of reforming and heating, a high octane reformate stream is formed in conduit 36, which is passed to reformate capture zone for suitable fractionation or distillation of the reformate into a predominantly aromatic stream which may be collected and a hydrogen and paraffin recycle stream (not shown) which may in part or in whole be returned to reformer zone 16, 24, or 34.

Figure 2:
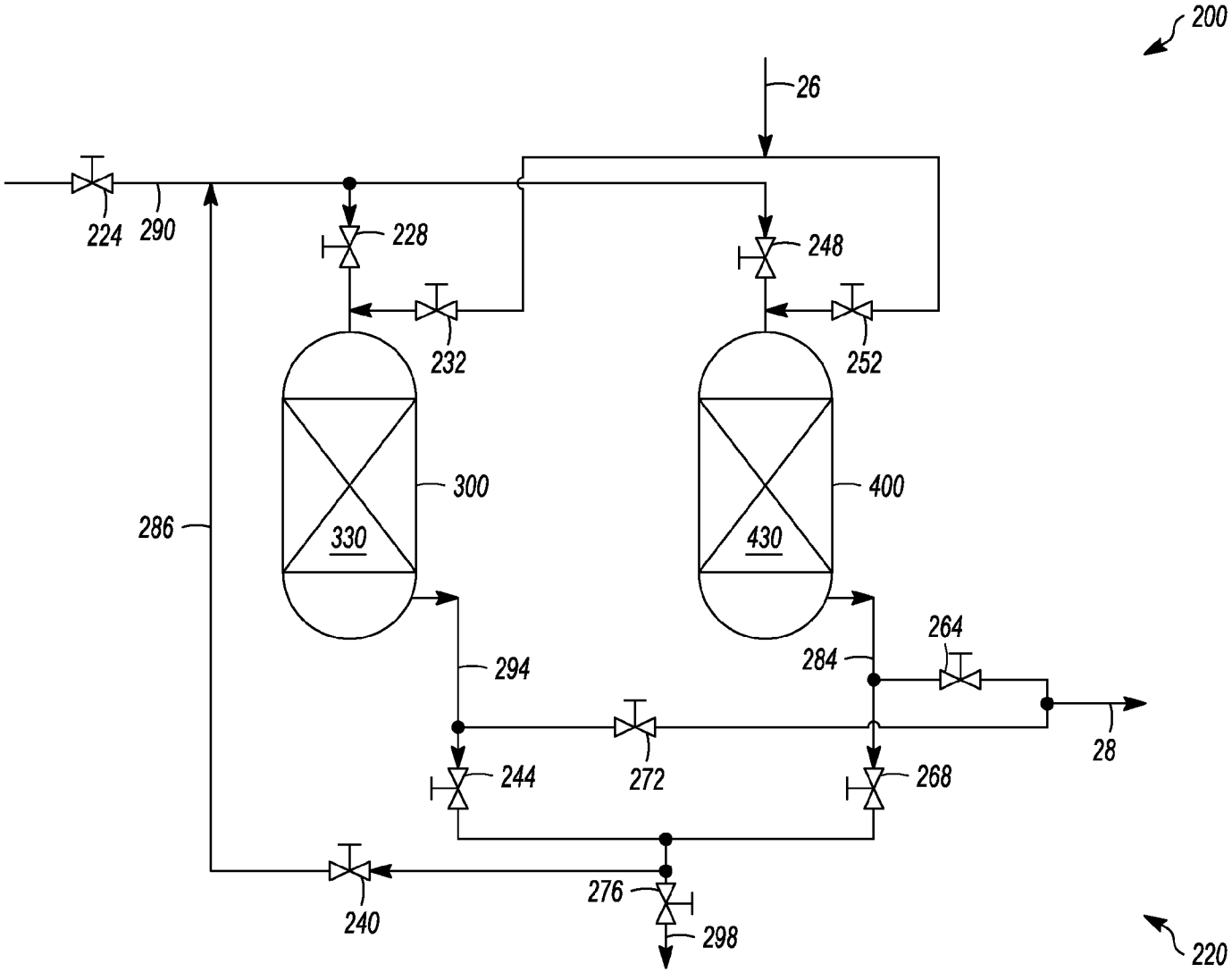
FIG. 2 is a schematic depiction of the exemplary adsorption zone.

Referring to FIG. 2, an exemplary adsorption zone 200 can include one or more valves 220, a first vessel 300, and a second vessel 400 in a lead lag mode of operation. The first and second vessels 300 and 400 can contain, respectively, a first adsorbent bed 330 and a second adsorbent bed 430. The first vessel 300 and the second vessel 400 can be swing bed adsorbers, in a parallel or series configuration, and alternate with adsorbing and desorbing. The beds 330 and 430 can contain an adsorbent and define an adsorbent volume. The one or more valves 220 can include valves 224, 228, 232, 240, 244, 248, 252, 264, 268, 272, and 276, which may be alternated in open and closed positions to control hydrocarbon flows through the adsorption zone 200.

The adsorbents in the first and second beds 330 and 430 can be, independently, a silica gel comprising iron, an activated carbon comprising iron, an activated alumina comprising iron, a silica-alumina gel comprising iron, a clay comprising iron, a molecular sieve comprising iron, or a mixture thereof. Preferably, the adsorbent is activated carbon comprising iron. The adsorbent in the first and second beds 330 and 430 can be the same or different. The adsorption of PNAs can occur at any suitable condition, such as a pressure of about 170 to about 4,300 kPa (25 psig to about 624 psig), a temperature of from about 10° C. to about 800° C. (50° F. to about 1472° F.), and a liquid hourly space velocity of about 0.1 to about 500 $hour^{-1}$. The adsorption can occur in an upflow, a downflow, or a radial manner.

In one exemplary embodiment, a first stream 26 including effluent from a reformation zone having no more than about 10,000 ppm, by weight, along with one or more PNAs is conducted adsorption zone 200. In addition, a stream including a light cycle oil (LCO) can be provided via the stream 290. The first vessel 300 can receive the stream 26 to adsorb PNAs, and the second vessel 400 can receive the stream 290 to desorb PNAs. For this configuration, the valves 224, 232, 248, 268, 272, and 276 can be open and the valves 228, 240, 244, 252, and 264 may be closed.

As a result, the effluent from a reformation zone in stream 26 can pass through the valve 232 and into the vessel 300 to have PNAs adsorbed onto the adsorbent bed 330. Adsorption can be conducted in an upflow, a downflow, or a radial manner. Afterwards, the reformate can exit the vessel 300 via a stream 294 and pass through the valve 272 and exit the zone via the stream 28. Typically, the effluent from the reformation zone stream in stream 28 exits the adsorption zone 200 with less, by weight, of one or more PNAs than was present in stream 26.

The LCO stream 290 can pass through a valve 248 and into the vessel 400, which has adsorbent saturated with adsorbed PNAs. The LCO can desorb the PNAs. Desorption can be conducted in an upflow, a downflow, or a radial manner. A volume of the LCO stream can be at least about 10, about 15, about 20, and even about 50 times the volume of the adsorbent bed 330 or 430 undergoing desorption for one or more PNAs. Although not wanting to be bound by theory, it is believed that 2-ring aromatic hydrocarbons are particularly advantageous for desorbing PNAs, as compared to aliphatic hydrocarbons, 1-ring and $4^{+}$-ring aromatics. The temperature for desorption is about 10-about 500° C. with an LHSV of about 0.01-about 500 $hr^{-1}$, and a pressure of about 170-about 21,000 kPa, preferably about 1,100-about 2,000 kPa. Although not wanting to be bound by theory, in one embodiment, the desorption is conducted under pressure to force the LCO into the pores of the adsorbent by capillary action and dissolve the PNAs. Generally, the adsorbent can be regenerated repeatedly, e.g., about 3-about 30 cycles or more before replacement. Thus, the amount of waste caused by replacing spent adsorbent can be reduced. The LCO stream now including desorbed PNAs can exit the second vessel 400 as a stream 284, pass the valves 268 and 276 to exit the adsorption zone 200 as a stream 298.

After the first vessel 300 has reached its adsorption capacity of PNAs and the second vessel 400 has been desorbed, the one or more valves 220 can be repositioned from a closed to an open position. As such, the effluent from a reformation zone in stream 26 may be routed through the second vessel 400 for adsorbing PNAs and routing the LCO through the first vessel 300 for desorbing.

Alternatively, the valves 224 and 276 can be closed and the valve 240 opened for recycling the LCO via a stream 286 through the second vessel 400 to continue desorbing. This allows maximizing the capacity of the desorbing LCO stream before routing the spent LCO stream to, e.g., fuel oil. It should be understood that additional lines and/or valves can be provided to operate the second vessel 400 with recycle LCO, to bypass the effluent from a reformation zone in stream 26 around the first and second vessels 300 and 400, and to allow replacement of the adsorbent once the adsorbent is no longer regenerable.

In addition, an optional nitrogen or inert gas purge may be conducted after adsorption of PNAs and after regeneration to purge the adsorbent bed 330 or 430 of, respectively, the effluent from a reformation zone and LCO. Thus, the adsorbent bed 330 or 430 can be purged of effluent from a reformation zone and LCO before, respectively, regeneration or adsorption.

EXAMPLES

The following examples are intended to further illustrate the subject embodiment(s). These illustrations are not meant to limit the claims to the particular details of these examples.

The following experiment utilizes two different carbon adsorbents to remove PNAs from a reformate. Subsequently, the reformate is analyzed to determine whether any PNAs remain in the reformate. The following experiments were conducted in an autoclave at 400° C. (752° F.) and 2068 kPa g (300 psig) using two different types of 12×40 mesh bituminous carbon adsorbents, see TABLE 1. The utilized adsorbents are bituminous carbons sold under the trade designation CAL and CPG by Calgon Carbon Corporation, Pittsburgh, Pa.

TABLE 1

| Carbon Adsorbent | Type | Surface Area ($m^2/g$) | Pore Volume ($cm^3/g$) | Pore Diameter (Å) | Ni (ppm) | V (ppm) | Fe (ppm) |
|---|---|---|---|---|---|---|---|
| Calgon CAL | Bituminous | 863 | 0.60 | 28 | 44 | 88 | 4030 |
| Calgon CPG | Acid Washed Bituminous | 899 | 0.67 | 26 | 16 | 18 | 1040 |

For better contact, the reformate feed and the carbon adsorbent were stirred at 250 RPM for 30 minutes. The starting reformate at 400° C. in the sealed autoclave exceeded the experiment pressure of 2068 psi (300 psig) such that part of the vapor had to be vented in order to bring the autoclave to the desired pressure. The reformate feed: carbon adsorbent volume ratio was about 3.5:1. The vented product, about 13% of the total reformate product was condensed collected and analyzed for PNAs. Only 1-2- and a small amount of 3-ring aromatics were detected in the condensed fraction, meaning that the PNAs were concentrated in the reformate fraction remaining in the autoclave.

The two carbon treated reformate products were analyzed qualitatively with Gas Chromatography-Time of Flight-Mass Spectrometry (GC-TOF-MS) and quantitatively with Comprehensive two-dimensional Gas Chromatography—Flame Ionization Detector (GC×GC FID) and the PNA concentrations were compared against the concentration in the reformate. The PNAs were grouped together as 4+ condensed ring aromatics. As can be seen from TABLE 2, the Calgon CPG adsorbent left behind traces of benz-anthracene in the reformate, while Calgon CAL was able to remove completely the PNAs.

TABLE 2

| Liquid Analyzed | 4+ Ring Aromatics (ppm) |
|---|---|
| Reformate Product | greater than 450 |
| Reformate after treatment with Calgon CAL carbon adsorbent | Not detected |
| Reformate after treatment with Calgon CPG carbon adsorbent | Traces of benz-anthracene |

The invention claimed is:

1. A process for adsorbing one or more polynuclear aromatics from at least one stream comprising reformate from a reforming zone using at least one adsorption zone, said process comprising:

a) passing at least a portion of at least one stream comprising reformate from the reforming zone through the adsorption zone wherein the adsorption zone comprises an adsorbent which comprises activated carbon and iron; and b) recovering reformate from the reforming zone having a reduced concentration of polynuclear aromatics.

2. The process of claim 1 wherein the reforming zone comprises a series of reforming reactors and wherein the stream comprising reformate is at least a portion of the effluent of the penultimate reforming reactor in the series of reforming reactors.

3. The process of claim 1 wherein the reforming zone comprises a series of reforming reactors, and wherein the stream comprising reformate is selected from the effluent of any of the reforming reactors in the series of reforming reactors.

4. The process of claim 1 wherein the adsorbent comprises from about 1000 to about 50,000 ppm iron on a carbonaceous basis.

5. The process of claim 1 wherein the PNAs comprise aromatics having three or greater fused rings.

6. The process of claim 1 wherein the PNAs comprise at least one of anthracenes, benz-antracenes, pyrenes, benzopyrenes, coronenes and ovalenes.

7. The process of claim 1 further comprising a second adsorption zone containing a second adsorbent comprising activated carbon and iron where the first and second adsorption zones operate in a lead-lag mode of operation.

8. The process of claim 1 wherein the adsorbent is selected from the group consisting of acid washed coconut shell, non-acid washed coconut shell, coal, lignite activated carbon, wood activated carbon, and mixtures thereof.

9. The process of claim 1 wherein the first adsorption zone is operated at a liquid hourly space velocity of from about 0.1 to about 50 LHSV and a pressure from about 101 kPa g to about 3,450 kPa g (atmospheric pressure to about 500 psia).

10. The process of claim 1 wherein the recovered reformate is a blending agent for gasoline.

11. The process of claim 7 wherein one or more of the PNAs are desorbed from the second adsorbent in the second adsorption zone by passing a petroleum fraction boiling in the range of about 200° C. to about 400° C. (about 400° F. to about 752° F.) through the second adsorption zone.

12. The process of claim 11 wherein the petroleum faction is substantially in the liquid phase.

13. The process of claim 11 wherein the temperature for desorbing at least one PNA from the second adsorbent includes about 10° C. to about 500° C. (about 50° F. to about 932° F.) and a pressure from about 170 kPa to about 21,000 kPa (about 25 psig to about 3046 psig).

14. A process for generating a hydrocarbon reformate with a reduced amount of polynuclear aromatic compounds, said process comprising:

(a) passing a heated hydrocarbon feed stream through a series of endothermic catalytic reforming reactors operated at a temperature of from about 427° C. to about 538° C. (about 800° F. to about 1000° F.) to reform said feed stream in the presence of a reforming catalyst to a hydrocarbon of higher octane value and to provide for a reforming reactor effluent containing polynuclear aromatic compounds;

(b) contacting said reforming reactor effluent with a first adsorbent, comprising activated carbon and iron, effective to selectively adsorb the polynuclear aromatic compounds and to permit nonpolynuclear aromatic hydrocarbons to pass over the first adsorbent comprising activated carbon and iron without being adsorbed and to form a first adsorbent bed effluent stream having a reduced amount of polynuclear aromatic compounds;

(c) passing the first adsorbent bed effluent stream to a final or second series of endothermic catalytic reforming reactors operated at a temperature of from about 427° C. to about 538° C. (about 800° F. to about 1000° F.) to reform the first adsorbent bed effluent stream to a hydrocarbon of higher octane value and to provide for a second reforming reactor effluent containing polynuclear aromatic compounds; and (d) recovering a hydrocarbon reformate having a reduced content of polynuclear aromatic compounds from the final or last of said series of reforming reactors.

15. The process of claim 14 wherein the feed stream comprises C6 to C12 naphtha having a boiling point in the range of about 38° C. to about 204° C. (about 100° F. to about 400° F.) and where the reformate has a higher octane than the feed.

16. The process of claim 14 wherein the adsorbent comprises from about 1000 to about 50,000 ppm iron on a carbonaceous basis.

17. The process of claim 14 further comprising a second adsorption zone containing a second adsorbent comprising activated carbon and iron where the first and second adsorption zones operate in a lead-lag mode of operation.

18. The process of claim 17 wherein one or more of the PNAs are desorbed from the second adsorbent in the second adsorption zone by passing a petroleum fraction boiling in the range of about 200° C. to about 400° C. (about 400° F. to about 752° F.) through the second adsorption zone.

19. The process of claim 18 wherein the petroleum faction is substantially in the liquid phase.

20. The process of claim 17 wherein the temperature for desorbing at least one PNA from the second adsorbent includes about 10° C. to about 500° C. (about 50° F. to about 932° F.) and a pressure from about 170 kPa g to about 21,000 kPa g (about 25 psig to about 3046 psig).

* * * * *